United States Patent [19]

Griffin

[11] 4,333,778

[45] Jun. 8, 1982

[54] FLOWER BUD

[76] Inventor: Mary T. Griffin, 3991 Shady Hill, Dallas, Tex. 75229

[21] Appl. No.: 119,438

[22] Filed: Feb. 7, 1980

[51] Int. Cl.[3] ..... A41G 1/00

[52] U.S. Cl. ..... 156/61; 428/24; 428/181

[58] Field of Search ..... 428/24, 25, 26, 181; 156/61

[56] References Cited

U.S. PATENT DOCUMENTS 1,470,969 10/1923 Greene ..... 156/61

1,731,089 10/1929 Adams ..... 428/26 X

*Primary Examiner*—Henry F. Epstein

*Attorney, Agent, or Firm*—Hubbard, Thurman, Turner, Tucker & Glaser

[57] ABSTRACT

A method for manufacturing an artificial rose bud primarily from a rectangular fabric section. With the rectangular fabric section positioned with a short side on the right, the right edge is folded down to a position near the lower edge to form a bias fold extending from the lower right-hand corner to a point on the top edge near the upper left-hand corner. The upper left-hand corner is then folded to a point near the lower left-hand corner and between that corner and the folded position of the upper right-hand corner. The lower right-hand corner is then folded to a point near the lower left-hand corner and between that corner and the folded position of the upper left-hand corner. The left and lower edges are then pleated and thereby formed into a bundle about the lower left-hand corner of the fabric section. A small diameter shaft forming a stem is preferably positioned on the fabric section before the first fold is made so that after pleating, the bundle is formed about the shaft. The bundle is then tied with a cord and wrapped with tape to bind all loose edges and simulate a flower stem.

19 Claims, 7 Drawing Figures

FLOWER BUD

BACKGROUND OF THE INVENTION

The present invention relates to artificial flowers and more particularly to a method for manufacturing artificial flower buds.

Artificial flowers have been manufactured in many different ways. Quite often these techniques include the molding of individual flower petals and the attachment of these parts to a central stem to form a complete flower. It is apparent that the cost of manufacturing such artificial flowers would be reduced by reduction in the number of parts required to make the individual flowers.

While artificial flowers have generally been used merely for decorative purposes, some of the artificial flowers have also found other uses. In particular, when an artificial flower or flower bud defines a cup shaped cavity it can be used as a rice holder and dispenser which is quite popular for wedding ceremonies. Such an artificial flower can be used as part of a decorative flower arrangement and then distributed to wedding guests carrying a small quantity of rice for use by the guests in the ceremony.

Thus, it is seen that it is desirable to provide a simple manner of producing such artificial flowers which are both decorative and useful.

SUMMARY OF THE INVENTION

In accordance with the present invention, an artificial flower bud is manufactured from a single rectangular section of fabric. A small diameter metal shaft or wire is preferrably laid across one corner of the fabric, for example the lower left corner and extends to a point near the center of the fabric section. The rectangular section is positioned with a short edge on the right and that right edge is then folded down onto the fabric section to a point spaced a short distance above the lower edge of the section. This first operation forms a bias fold extending from the lower right corner to the upper edge near the upper left corner. The upper left corner is then folded downward to a point lying between the lower left corner and the folded position of the upper right-hand corner. The folded left edge of the fabric section is then preferably pleated to form a partial bundle on the left side of the metal shaft. The lower right corner is then folded to the left to a point lying between the lower left corner and the folded position of the upper left corner. The folded lower edge of the fabric section is then pleated to form a complete bundle about the metal shaft and a small cord or thread is wrapped around the bundle to fix the resulting configuration of an artificial flower. The bundle is then preferrably wrapped with tape to bind all exposed fabric edges.

BRIEF DESCRIPTION OF THE DRAWINGS

The present invention can be better understood by reading the following detailed description of the preferred embodiment with reference to the accompanying drawings wherein.

DESCRIPTION OF THE PREFERRED EMBODIMENTS

Figure 1:
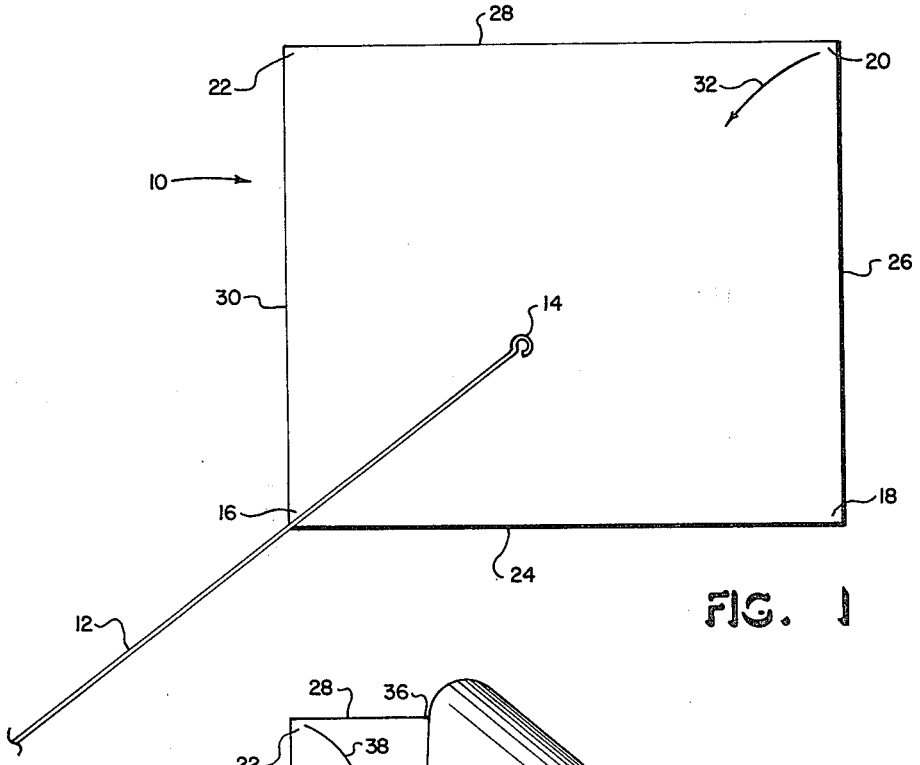
FIG. 1, is a plan view of a rectangular fabric section and a small diameter shaft positioned for the beginning of the manufacturing process.

With reference now to the drawings, there is illustrated each of the steps involved in manufacturing an artificial rose bud according to the present invention. In particular, in FIG. 1, there is illustrated a rectangular fabric section 10 and a small diameter wire shaft 12. The fabric section 10 is in the preferred embodiment formed from a off-white satin fabric such as is often used in wedding dresses. The dimensions of section 10 are typically four and one-quarter inches by five inches. The wire shaft 12 is a common soft steel rod having a preformed loop 14 in one end and is commonly employed in flower arrangements. The loop 14 is laid at a point somewhat below and to the left of the center of section 10 and the shaft 12 extends over and beyond the lower left-hand corner 16 of the fabric section 10. For purposes of description the section 10 will be described as having in addition to the left-hand corner 16, a lower right-hand corner 18, an upper right-hand corner 20, an upper left-hand corner 22, a lower edge 24, a right edge 26, an upper edge 28 and a left edge 30. Each of the edges 24, 26, 28, and 30 is preferrably cut substantially parallel to the grain of the fabric.

Figure 2:
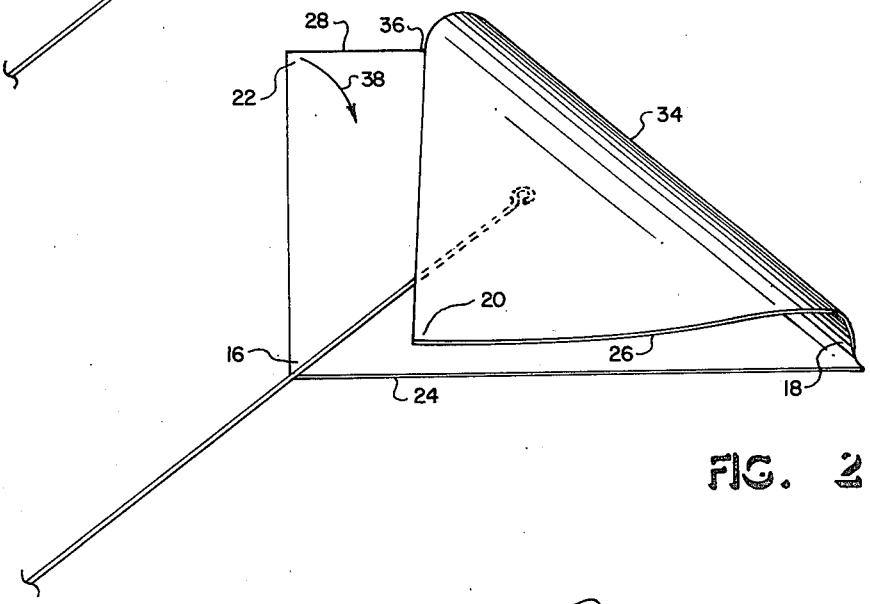
FIG. 2, is a perspective view illustrating the first folding step of the method.

With reference now to FIG. 2 and FIG. 1, the first step in the process will be illustrated. The arrow 32 in FIG. 1 illustrates that the upper right-hand corner 20 is folded down towards lower left-hand corner 16 of the section 10. As shown in FIG. 2 this fold is made so that the right edge 26 is positioned near and substantially parallel to the lower edge 24. Edge 26 need not be exactly parallel and may come close to or contact the lower edge 24 at the lower right-hand corner 18 if desired. In any case, this first step forms a bias fold 34 extending substantially from the lower right-hand corner 18 to a point 36 on upper edge 28 near, but spaced from the upper left corner 22. This bias fold 34 is not creased, but is allowed to remain rounded as much as possible to provide a smooth contour for the finished product.

Figure 3:
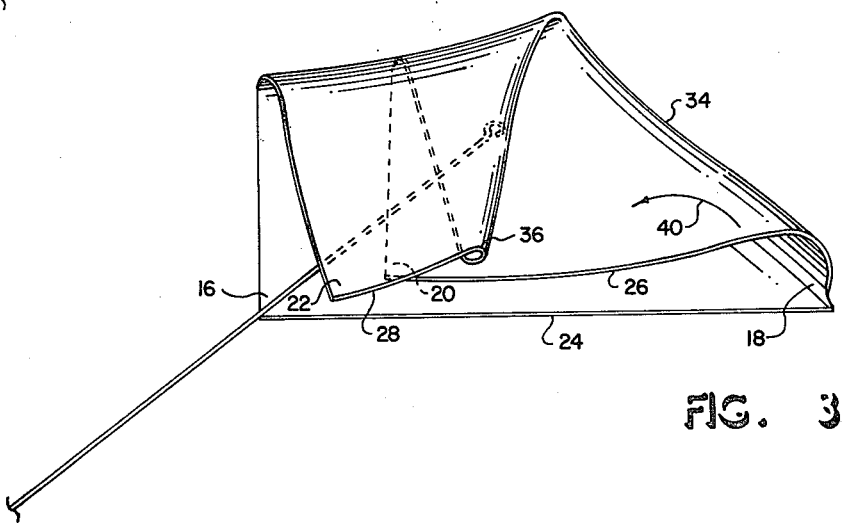
FIG. 3, is a perspective view illustrating the second fold of the manufacturing process.

With reference now to FIGS. 2 and 3, the next step of the process is illustrated. In particular, the arrow 38 in FIG. 2 illustrates that the upper left-hand corner 22 is folded down to a point substantially intermediate the lower left-hand corner 16 and the folded position of upper right-hand corner 20. This new folded position is shown in FIG. 3. That portion of upper edge 28, between the upper left-hand corner 22 and the point 36 is therefore positioned slightly above lower edge 24 and partly overlies the right edge 26. With this fold a compound curve of the bias fold 34 has been generated on the left side of the final flower bud.

Figure 4:
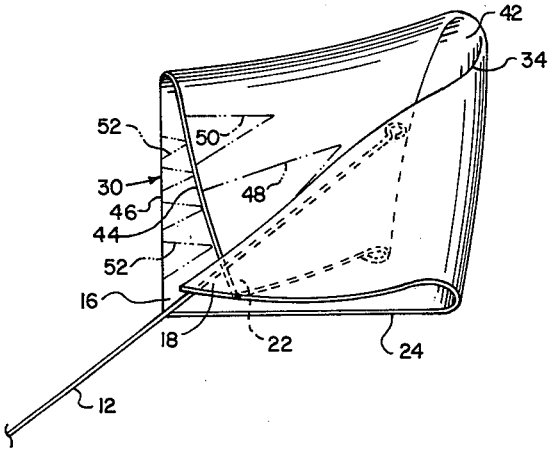
FIG. 4, is a perspective view illustrating the third fold of the manufacturing process.

With reference now to FIGS. 3 and 4, the final folding step of the method is illustrated. In particular, the arrow 40 in FIG. 3 illustrates that the lower right-hand corner 18 is folded to the left to a point between the lower left-hand corner 16 and the folded position of the upper left-hand corner 22. This folded position is shown in FIG. 4. With this last fold the complete compound curve of the bias fold 34 is formed. In addition, it is seen that the left edge 30 and the lower edge 24 are each substantially folded back upon themselves. It can also be seen that each of the folds is formed generally over the metal shaft 12 which provides a convenient gripping point for manual holding of the fabric in these positions during the manufacturing process. In this regard, it can be seen that the flexibility of the fabric, particularly in the bias fold, generates pleasing contours in the fabric as the various folds are made. It has been found quite desirable for the flower assembler to position a cylindrical object, such as an index finger, in the aperture 42 defined by the curved bias fold 34 in FIG. 4 during the folding steps to insure that aperture 42 remains open.

Also illustrated in FIG. 4 are the locations of pleats to be taken in front and rear portions 44 and 46 of the left edge 30 in the next step of the process. A first large pleat 48 consuming about one-half the length of the front portion 44 adjacent the corner 22 is taken first. A second smaller pleat 50 is then taken in this front portion 44. Four or five smaller and approximately equal sized pleats 52 are then pinched in the rear portion 46 of the left edge 30.

Figure 5:
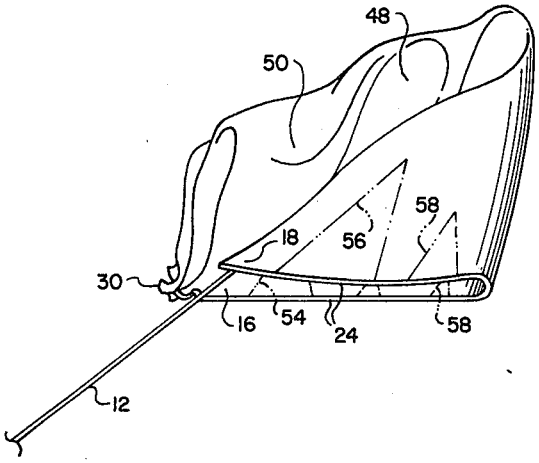
FIG. 5 illustrates the pleating of the left edge of the fabric.

With reference to FIG. 5, the configuration of the flower bud after the pleats illustrated in FIG. 4 have been taken is shown. In particular, the left edge 30 is brought into a tight bundle on the left side of the wire stem 12. In FIG. 5 there is also illustrated the location of the pleats which are taken in the lower edge 24. In particular, a fairly large pleat 54 consuming between one-quarter and one-half of the rear half of lower edge 24 is shown adjacent the corner 16. In similar fashion, a fairly large pleat 56 is shown consuming between one-quarter and one-half of the forward portion of lower edge 24 adjacent the lower right corner 18. In the preferred embodiment the pleat 54 is taken first and then the pleat 56 is taken. Following this, additional smaller pleats 58 are taken alternately from the rear portion and forward portions of the lower edge 24 until the entire lower edge 24 has been formed into a tight bundle against the right side of wire stem 12.

Experience with the manufacturing process has shown that a slight variation of the above described steps is preferred for best results. The pleats are preferably taken in the folded left side 30 before the lower side 24 is folded as shown in FIG. 4. The FIG. 4 illustration is intended to show the relative position of the lower right corner 18 after folding. FIG. 5 does not clearly show the locations of corners 16 and 22 since they are formed into a partial bundle against the left side of shaft 12.

Figure 6:
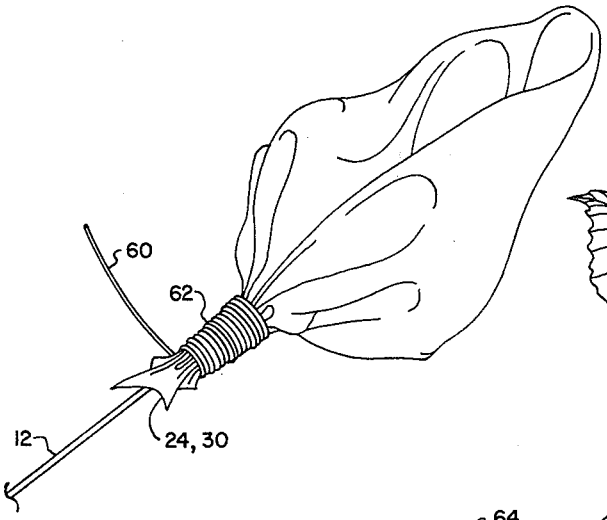
FIG. 6 illustrates the pleating of the lower edge of the fabric section and the binding of the resulting bundle with a thread.

FIG. 6 illustrates the flower bud after all pleats have been taken so that the left edge 30 and lower edge 24 have been formed into a pleated bundle 62 about the wire stem 12. A small cord 60, preferably a length of thread, is then wrapped tightly around the bundled portion of edges 24 and 30. The thread 60 fixes the artificial rose bud onto the stem 12 and freezes the configuration.

Figure 7:
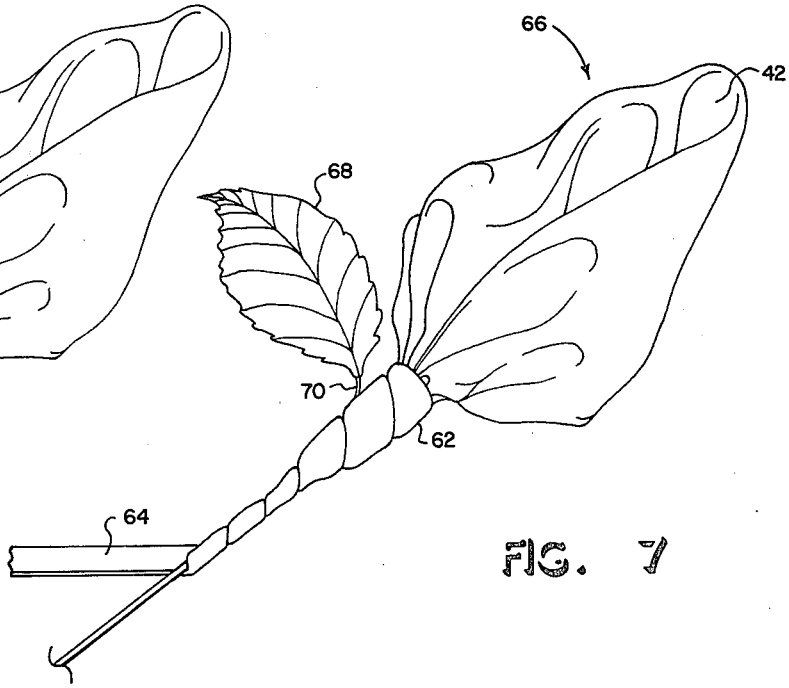
FIG. 7 illustrates the wrapping of the bundle with tape and attachment of an artificial leaf.

FIG. 7 illustrates the completed form of the artificial rose bud. In particular, a length of preferrably green adhesive tape 64 has been wrapped in a spiral about the bundle 62 and at least a portion of the wire stem 12 to simulate the bud and stem arrangement. To complement the completed flower bud, generally designated 66, an artificial leaf 68 is preferrably added. The leaf 68 has a wire stem 70 which is simply laid along side either the bundle 62 or the wire stem 12 as tape 64 is applied and thereby attached to the completed flower 66.

As is seen in FIG. 7, the completed assembly quite closely simulates a natural flower bud and, when formed from a satin type material, is quite attractive. In addition, the aperture 42 and the body of rose bud 66 provides a convenient container for holding approximately a teaspoon of rice. The buds 66 filled with rice may be conveniently formed into a flower arrangement as part of the typical wedding decorations. At the traditional time of rice throwing the rose buds may be distributed to wedding guests who find it quite convenient to grip the rose bud 66 by stem 12 and very easily distribute a shower of rice over the departing newly married couple. The artificial rose bud 66 then forms an attractive souvenir for the wedding guests.

While the present invention has been described with respect to use of a satin fabric section, it is apparent that other types of fabric and even some forms of paper material would be useful. Thus, some forms of paper, such as crepe paper, which tend to be elastic in a particular direction can provide the equivalent of the bias fold 34 in the present invention to therefore form an attractive flower bud. The satin or similar material has however been found to be most attractive and is therefore preferred. While the present invention has been illustrated and described with respect to a particular method of assembling an artificial rose bud, it is apparent that various modifications and changes can be made within the scope of the present invention as defined by the appended claims.

What is claimed is:

1. A method of making an artificial flower bud from a single piece of fabric comprising:

(a) cutting a rectangular section of fabric having right and left short edges and upper and lower long edges;

(b) folding the right edge back onto said fabric section with said right edge near and substantially parallel to said lower edge, to form a bias fold extending substantially from a lower right corner of said section to a point on said upper edge spaced from the upper left corner of said section;

(c) folding the upper left corner of said section down to a point between the lower left section corner and the upper right corner;

(d) folding the lower right corner of said section over said section to a point between said upper left corner and said lower left corner;

(e) forming pleats in said left and lower edges to gather said left and lower edges into a bundle; and (f) wrapping said bundle with a cord to permanently fix the configuration of said artificial flower bud.

2. A method according to claim 1 further including, prior to step (b):

positioning a small diameter shaft on said section of fabric with one end near the center of said section and the shaft extending across and beyond the lower left corner.

3. A method according to claim 2 further including, after step (f):

wrapping said bundle and at least a portion of said shaft with decorative adhesive tape to cover said cord and exposed edges of said fabric section and to simulate a flower stem.

4. A method according to claim 3 further including, attaching an artificial leaf to said artificial flower by inserting a stem of said leaf under said tape during said wrapping step.

5. A method according to claim 1 wherein after step (d) said left edge and said lower edge each include a forward portion and a rear portion and step (e) includes:

pinching two pleats in the left edge forward portion;

pinching a plurality of pleats in the left edge rear portion; and alternately pinching pleats in the lower edge rear portion and forward portion until said lower edge is gathered into a bundle.

6. A method according to claim 5 where said step of pinching two pleats in the left edge forward portion includes:

pinching a first pleat consuming more than half of said left edge forward portion adjacent said upper left corner; and pinching a second pleat smaller than said first pleat in said left edge forward portion consuming the remainder of said left edge forward portion.

7. A method according to claim 5 where the step of pinching a plurality of pleats in the left edge rear portion includes:

pinching four or more substantially equally sized pleats in said left edge rear portion beginning adjacent said lower left corner and continuing until the remainder of said left edge rear portion is gathered into a bundle.

8. A method according to claim 5 wherein the step of pinching pleats in the lower edge includes:

pinching a first pleat in said lower edge rear portion consuming from one-quarter to one-half of said portion adjacent said lower left corner;

pinching a second pleat in said lower edge forward portion consuming from one-quarter to one-half of said portion adjacent said lower right corner;

alternately pinching pleats, smaller than said first and second pleats, in said lower edge rear portion and forward portion until the remainder of said lower edge is gathered into a bundle.

9. A method according to claim 1 further including during steps (c) and (d) positioning a cylindrically shaped element on a forward surface of said bias fold and substantially perpendicular to said bias fold, to thereby form a rounded opening defined by said bias fold after completion of step (d) and subsequently removing said cylindically shaped element.

10. A method of making an artificial flower bud from a single piece of fabric comprising:

(a) cutting a rectangular section of fabric having right and left short edges and upper and lower long edges;

(b) folding the right edge back onto said fabric section with said right edge near and substantially parallel to said lower edge, to form a bias fold extending substantially from a lower right corner of said section to a point on said upper edge spaced from the upper left corner of said section;

(c) folding the upper left corner of said section down to a point between the lower left section corner and the upper right corner;

(d) forming pleats in said left edge to gather said left edge into a first partial bundle;

(e) folding the lower right corner of said section over said section to a point between said upper left corner and said lower left corner;

(f) forming pleats in said lower edge to gather said lower edge into a second partial bundle adjacent said first partial and forming a complete bundle therewith; and (g) wrapping said complete bundle with a cord to permanently fix the configuration of said artificial flower bud.

11. A method according to claim 10 further including, prior to step (b):

positioning a small diameter shaft on said section of fabric with one end near the center of said section and the shaft extending across and beyond the lower left corner.

12. A method according to claim 11 further including, after step (g):

wrapping said complete bundle and at least a portion of said shaft with decorative adhesive tape to cover said cord and exposed edges of said fabric section and to simulate a flower stem.

13. A method according to claim 12 further including, attaching an artificial leaf to said artificial flower by inserting a stem of said leaf under said tape during said wrapping step.

14. A method according to claim 10 wherein after step (c) said left edge includes a forward portion and a rear portion and step (d) includes:

pinching two pleats in the left edge forward portion; and pinching a plurality of pleats in the left edge rear portion until said left edge is gathered into said first partial bundle.

15. A method according to claim 14 where said step of pinching two pleats in the left edge forward portion includes:

pinching a first pleat consuming more than half of said left edge forward portion adjacent said upper left corner; and pinching a second pleat smaller than said first pleat in said left edge forward portion consuming the remainder of said left edge forward portion.

16. A method according to claim 14 where the step of pinching a plurality of pleats in the left edge rear portion includes:

pinching four or more substantially equally sized pleats in said left edge rear portion beginning adjacent said lower left corner and continuing until the remainder of said left edge portion is gathered into said first partial bundle.

17. A method according to claim 10, wherein after step (e) said lower edge includes a forward portion and a rear portion and step (f) includes;

alternately pinching pleats in the lower edge rear portion and forward portion until said lower edge is gathered into said second partial bundle.

18. A method according to claim 17 wherein the step of pinching pleats in the lower edge includes:

pinching a first pleat in said lower edge rear portion consuming from one-quarter to one-half of said portion adjacent said lower left corner;

pinching a second pleat in said lower edge forward portion consuming from one-quarter to one-half of said portion adjacent said lower right corner;

alternately pinching pleats, smaller than said first and second pleats, in said lower edge rear portion and forward portion until the remainder of said lower edge is gathered into said second partial bundle.

19. A method according to claim 10 further including during steps (c) and (e) positioning a cylindrically shaped element on a forward surface of said bias fold and substantially perpendicular to said bias fold, to thereby form a rounded opening defined by said bias fold after completion of step (e) and subsequently removing said cylindically shaped element.

* * * * *